United States Patent [19]

Levine et al.

[11] 4,428,848

[45] Jan. 31, 1984

[54] MOLYBDENUM DERIVATIVES AND LUBRICANTS CONTAINING SAME

[75] Inventors: Stephen A. Levine; Raymond C. Schlicht, both of Fishkill; Harry Chafetz, Poughkeepsie, all of N.Y.; James R. Whiteman, Port Arthur, Tex.

[73] Assignee: Texaco Inc., White Plains, N.Y.

[21] Appl. No.: 319,780

[22] Filed: Nov. 9, 1981

[51] Int. Cl.[3] ..... C10M 1/48

[52] U.S. Cl. ..... 252/32.7 HC; 252/46.4

[58] Field of Search ..... 252/32.7 HC, 18, 25, 252/46.4; 260/429 R

[56] References Cited

U.S. PATENT DOCUMENTS 3,140,997 7/1964 Price ..... 252/18
3,223,625 12/1965 Cyphers et al. ..... 252/32.7 HC
3,256,184 6/1966 Harting et al. ..... 252/18
4,202,781 5/1980 Sabol et al. ..... 252/32.7 HC

*Primary Examiner*—Jacqueline V. Howard
*Attorney, Agent, or Firm*—Carl G. Ries; Robert A. Kulason; Henry W. Archer

[57] ABSTRACT

Disclosed are novel compounds prepared by the reaction of an adduct of a phosphosulfurized polyisoalkylene or alpha olefin with an acidified hexavalent molybdenum salt which give enhanced copper corrosion protection relative to the non-molybdenum treated adducts when incorporated in lubricants.

Also disclosed is the combination of such compounds with a zinc dialkyldithiophosphate, which combination imparts to lubricants an oxidation inhibition greater than is obtainable with either the zinc dialkyldithiophosphate or the molybdenum-containing adduct alone.

11 Claims, No Drawings

MOLYBDENUM DERIVATIVES AND LUBRICANTS CONTAINING SAME

BACKGROUND OF THE INVENTION

1. Field of the Invention

This invention concerns novel molybdenum-containing compounds which find utility in lubricants as corrosion inhibitors; in particular, when combined with zinc dialkyldithiophosphates.

2. Description of Prior Disclosures

Many diverse molybdenum-containing compounds are known in the prior art to enhance the properties of lubricants. Such compounds are disclosed, for example, in U.S. Pat. Nos. 2,805,997; 2,987,478; 3,010,902; 3,223,625; 3,453,212; 3,541,014; 4,093,614; 4,098,705; 3,356,702 and in Japanese Pat. No. 4,856,202. Of particular interest are U.S. Pat. Nos. 2,805,997 and 3,223,625. The first of these describes the use of low molecular weight alkyl molybdate esters in lubricants as corrosion inhibitors. The second patent describes the preparation of molybdenum-containing organic compounds by an acidification technique and process that requires an ether extraction step. The products of this invention, however, are not esters of molybdic acid. Further, they do not always require acidification as a necessary step in their preparation, nor do they require the use of a halogen acid.

SUMMARY OF THE INVENTION

The invention comprises compositions of matter consisting essentially of the product obtained by reacting at between 100° and 350° C., a phosphosulfurized polyisoalkylene or alpha olefin adduct and a hexavalent molybdenum salt previously treated with from 0.5 to 3 times the stoichiometric amount of acid required to neutralize the salt.

The invention also provides an oxidation inhibiting mixture consisting of the synergistic combination of the foregoing with a zinc dialkyldithiophosphate (ZDDP) in which the two components are present in weight ratios of 1:10 to 10:1, respectively. A preferred zinc compound has the formula:

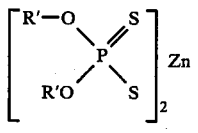

in which R′ is a normal or branched hydrocarbyl radical having 3 to 20 carbon atoms, or R′ may represent a combination of two or more of such hydrocarbyl radicals either in the same zinc dialkyldithiophosphate molecule or in physical mixtures of individual zinc dialkyldithiophosphates. Further, R′ may be a radical possessing an alkylaryl function, the radical having the formula:

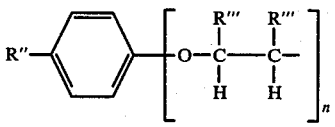

in which R′ has the values described above, R″ is an alkyl radical having from 1 to 30 carbon atoms, and R‴ is hydrogen or an alkyl radical having from 1 to 4 carbon atoms and n is an integer from 0 to 10. Particularly effective compounds in this latter class are the zinc di-nonylphenyldithiophosphate, zinc di-(dodecylphenoxyethyl) dithiophosphate and zinc di-(nonylphenoxyethoxyethyl) dithiophosphate. Zinc di-(nonylphenoxyethyl) dithiophosphate is prepared by reacting a nonylphenolethylene oxide compound with phosphorus pentasulfide followed by neutralization of the acid formed with a basic zinc compound, such as zinc carbonate, zinc oxide or zinc hydroxide. The general preparation of the compounds in this class is disclosed in U.S. Pat. Nos. 2,344,395 and 3,293,181. In use, it is convenient to prepare a mineral oil solution of the zinc (di($C_{6-15}$ alkylphenoxypolyalkoxyalkyl) dithiophosphate containing from 50 to 75 weight percent of the zinc salt.

DISCLOSURE

The preparation of the reaction product used in a lubricant according to the present invention is relatively uncomplicated and can be economically conducted.

The starting phosphosulfurized polyisoalkylene adduct which has a molecular weight of about 300 to about 10,000 is prepared as described in coassigned U.S. Pat. No. 3,087,956 by reacting about 5 to 40 percent of $P_2S_5$ with a hydrocarbon at 100° to 320° C. under a non-oxidizing atmosphere. A particularly suitable starting adduct has a 2:1 alpha olefin-$P_2S_5$ molar ratio.

To prepare one embodiment of the invention, where the adducts are a mixture having the general composition $RPS_w$, where R is a hydrocarbyl moiety having from 8 to 180 carbon atoms, and w=1 to 3, a hexavalent molybdenum salt, preferably $(NH_4)_6Mo_7O_{24}$, is dissolved in water. Concentrated mineral acid is added portionwise to the resulting solution which then is heated with stirring to 40° to 100° C. The resulting product is extracted with an alkyl ether such as ethyl ether. The phosphosulfurized adduct is added to the ether extract and the solution is heated at 110° C. until nearly all the ether distills off. A paraffinic distillate oil is added as a diluent and the remaining ether is distilled, leaving behind the product.

In another embodiment, where the starting adduct has the general composition as above, the same is dissolved in a polar or non-polar solvent and heated with a $H_2SO_4$-acidified aqueous solution of the hexavalent molybdenum salt. The water is removed by azeotropic distillation to give the product.

As determined from their chemical analysis and on the basis of their preparation, the products of the invention can be characterized by the formula:

$$R-PS_w[Mo_xO_y]_z$$

where w=1 to 3, x=1 or 2, y is 1 to 3, and z=0.05 to 2 and R is an alkenyl radical derived from a polyolefin such as polybutenes, polypropylenes, or a linear olefin such as normal alpha-olefins or cracked paraffin hydrocarbons, having a molecular weight from 56 to 5100.

The best modes of practicing the invention are illustrated in non-limiting fashion by the following examples. Examples 1 and 2 show the preparation of an alpha-olefin $P_2S_5$ adducts.

EXAMPLE 1

Preparation of a 2:1 (molar) n-Octadecene-1:$P_2S_5$ Reaction Product

A mixture of 504.0 g. (2.0 moles) n-octadecene-1 and 222 g. (1.0 mole) $P_2S_5$ were heated under $N_2$ to 140° C. where an exotherm raised the temperature to 155°. After heating to 190° the mixture was held for 5 hours until $H_2S$ evolution was essentially complete. Then the mixture was cooled, dissolved in cyclohexane, and filtered. Stripping under vacuum to 100° at 10 mm. gave 695 g. of product. The analyses were 9.1% P and 18.5% S (vs. 8.95% and 18.5%, respectively calculated for the structure $(C_{18}H_{35})_2P_2S_4$).

EXAMPLE 2

Preparation of a 2:1 (molar) n-Tetradecene-1:$P_2S_5$ Reaction Product

The procedure of Example 1 was followed except the olefin used was 431.2 g. (2.0 mole) tetradecene-1, and the reaction was conducted at 180° for 5 hours. The reaction mixture was filtered in n-heptane solution, and stripped to 150° at 10 mm. The product yield was 6.21 g., and the analytical results were 10.0% P and 20.5% S (vs. 10.0% and 20.7% calculated for $(C_{14}H_{27})_2P_2S_4$).

The intermediate products of Examples 1 and 2 are postulated to have the structure

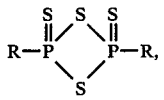

where R is an alkenyl group having from 8 to 30 carbon atoms. However, cyclic or linear polymers of the structure

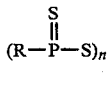

may also be present as well as various side-reaction products.

EXAMPLE 3

Preparation of a Molybdenum Derivative of a n-Octadecene-1:$P_2S_5$ Product:Hydrocarbon Solvents To a solution at room temperature of 36.3 g. (0.15 mole) sodium molybdate $0.2H_2O$ in 50 ml. water, 15.0 g. (0.15 mole) conc. $H_2SO_4$ was added at 60° max. Then 103.8 g. (0.3 g. at .P) of a 2:1 mole ratio n-octadecene:$P_2S_5$ product (Ex. 1) dissolved in 150 ml. n-heptane was added, followed by 120 ml. toluene. After 1 hour total reflux at 82° C., water (55 ml.) was removed by azeotropic distillation over 5 hours at 103°, max. The mixture was cooled to room temperature, filtered, and stripped to 100° C. at 10 mm. The yield was 112 g. of a deep blue product. The elemental analyses were %Mo 7.6; %P 6.7; %S 14.8.

EXAMPLE 4

Preparation of a Molybdenum Derivative of a n-Octadecene-1:$P_2S_5$ Product:Ethyl Acetate as Primary Solvent The same materials as in Ex. 3 were used, except that 200 ml. ethyl acetate was used in place of the toluene and only 50 ml. n-heptane was charged to enhance water separation in the azeotropic distillation step. After 6 hours at 85° C. max., 55 ml. aqueous distillate was removed. On work-up, 123.4 g. semi-solid product was obtained. The elemental analyses were: %Mo 10.35; %S 14.8.

EXAMPLE 5

To a flask containing 88.3 g. (0.07 mole) of ammonium paramolybdate dissolved in 250 ml. of water was added 145 ml. of concentrated hydrochloric acid in a dropwise fashion. This solution was heated and stirred at 50° C. The product was transferred to a separatory funnel and extracted with one liter of ethyl ether. The aqueous layer was drawn off and discarded. 300 grams (0.467 m) of a phosphosulfurized polyisobutylene adduct (made by reacting polybutene with $P_2S_5$) and the ether extract were charged to a flask and stirred at room temperature until the adduct was dissolved in the ethereal extract. The solution was then heated at 110° C. When almost all of the ether had distilled off, 300 g. of a paraffinic distillate oil (SUS Viscosity 39 at 210° F.) was added as diluent. The remaining ether was then distilled off and the residue filtered. The product (558 g.) was an amber liquid having the following analysis: 0.37% Mo, 2.1% P, and 3.54% S.

The products of the above examples were tested by various tests with the results tabulated in Table 1, below.

Considering each test in turn, the Bench L-38 Test is based on Federal Test Method No. 791a, Method 3405.1 and provides a method for studying the oxidation and copper-lead bearing corrosion characteristics of crankcase oils. In carrying out this test, copper-lead bearings are weighed at the end of a 40 hour test. The engine components are visually rated and used oil analyses are obtained. The copper strip test is based on ASTM Method D130 and involves immersing a polished copper strip in a given quantity and heating for a temperature and time characteristic of the mateial being tested. At the end of this period, the copper strip is removed, washed and compared with the ASTM Copper Strip Corrosion Standards.

The 4-Ball Test used is run for 1 hour at 1800 rpm/200° F./40 kg. load. The friction coefficient was measured at the end of the test when the anti-friction film is fully developed. In this test the antiwear properties of oils and greases are measured in a wear tester with and without the additive to be tested.

Considering the data of Table I, it is readily seen that at both the 0.10 and 0.13 phosphorus levels the adduct by itself and with ZDDP give excellent wear and oxidation protection and gives good L-38 bearing corrosion protection, although not seen when tested by the copper corrosion test.

The molybdenum-containing adduct is able to achieve equivalent performance to the reference blend using only 40% of the phosphorus content of the reference blend. Therein lies its superiority to the ZDDP contained in the reference blend.

The improvement obtained with the Mo-containing adduct plus ZDDP is readily apparent in terms of copper corrosion, wear, and oxidation protection. Although the results of the Bench L-38 test are greater than for the comparison blends, they are well within the acceptable performance limit (40 mg. max.).

Lubricating compositions according to the present invention contain at least one of the above products or a mixture of such product with a zinc dialkyldithiophosphate, as above defined in an amount from about 0.2 to 10 percent; preferably between 0.5 and 5.0 percent by weight and especially at least 1 percent by weight and from 0 to 10 weight percent of a zinc dialkyldithiophosphate.

The present compositions can also contain a combination of other well known additives in an amount sufficient to achieve each additive's function.

Lubricating compositions according to this invention comprise a major amount of any of the well-known types of oils of lubricating viscosity as suitable base oils. They include hydrocarbon or mineral lubricating oils of naphthenic, paraffinic and mixed naphthenic and paraffinic types. Such oils may be refined by any of the conventional methods such as solvent refining and acid refining. Synthetic hydrocarbon oils of the alkylene polymer type or those derived from coal and shale may also be employed. Alkylene oxide polymers and their derivatives such as the propylene oxide polymers and their ethers and esters in which the terminal hydroxyl groups have been modified, are also suitable. Synthetic oils of the dicarboxylic acid ester type including dibutyl adipate, di-2-ethyl-hexyl sebacate, di-n-hexyl fumaric polymer, dilauryl azelate, and the like may be used. Alkyl benzene types of synthetic oils such as tetradecyl benzene, etc., are also included.

A typical lubricating composition of matter formulated according to this invention contains from 0.2 to 25 weight percent of the present composition; 0 to 10 weight percent of a zinc dialkyldithiophosphate; 0.00 to 0.50 weight percent calcium or magnesium derived from one or more calcium or magnesium sulfonate, phenate or sulfurized phenate any or all of which can be overbased by calcium or magnesium carbonate; 0.01 to 0.15 weight percent of nitrogen derived from a dispersant alkenyl succinimide, or alternatively 1 to 15 weight percent of a dispersant; 0 to 15 weight percent of a viscosity index improver; 0 to 1 weight percent of a pour dispersant; 0 to 1 weight percent of a supplemental ashless antioxidant; 0 to 1 weight of an ashless rust inhibitor; the balance an oil of lubricating viscosity.

TABLE 1

| Composition, % | Ref. | Adduct | Adduct + ZDDP | Adduct + ZDDP | Mo Cont'g Adduct | Mo Cont'g Adduct + ZDDP |
|---|---|---|---|---|---|---|
| Base Blend* | 98 | 98 | 98 | 98 | 98 | 98 |
| ZDDP**, % Zn | 0.075 | — | 0.075 | 0.075 | — | 0.075 |
| Adduct | — | 2 | 1.33 | 0.68 | — | — |
| Mo-Cont'g Adduct | — | — | — | — | 2 | 1.33 |
| Mineral Oil | 1.32 | — | — | 0.65 | — | — |
| Phosphorus, % Calc | 0.10 | 0.10 | 0.13 | 0.10 | 0.04 | 0.10 |
| Dispersancy | 3.5 | 3.5 | 2.5 | 2.5 | 2.0 | 3.0 |
| Cu Corr., 3 hr./300° F. | 1A | 4B | 4A | 4A | 4A | 1A |
| 4 Ball Wear | 0.38 | 0.40 | 0.43 | 0.41 | 0.36 | 0.41 |
| Oxidation[1], 48 Hr. | 50 | −1.9 | 57.5 | 40.0 | 189 | 35.8 |
| 72 Hr. | TVTM[2] | 71.2 | 37.9 | 52.2 | TVTM[2] | 51.6 |
| Bench L-38 Test[3], BWL | | 0.5 | 7.4 | 9.0 | | 14.4 |

*Base Blend contains dispersant, detergent, viscosity index improver, ashless antioxidant, rust inhibitor, pour point depressant, and mineral oil.
**ZDDP-Zinc dialkyldithiophosphate
[1]Oxidation test correlates with the oxidation portion of Seq. IIIC multicylinder engine test-results are % viscosity increase.
[2]TVTM - Too viscous to measure.
[3]Cu Pb Bearing test correlates with the CLR L-38 engine test-results are mg. Bearing Weight Loss (BWL).

What is claimed is:

1. An oxidation inhibiting mixture for lubricants consisting of the combination of the product obtained by reacting at between 100 and 350 degrees C., a phosphosulfurized polyisoalkylene or alpha olefin adduct and an aqueous solution of a hexavalent molybdenum salt treated with 0.5 to 3 times the stoichiometric amount of acid required to neutralize said salt, said composition having the formula:

$$R-PS_w[Mo_xO_y]z$$

wherein R is an alkenyl radical having a molecular weight ranging from 56 to 5100; w is 1 to 3; x is 1 or 2; y is 1 to 3 and z is 0.05 to 2; with a zinc dialkyldithiophosphate in which the two components are present in weight ratios of 1:10 to 10:1, respectively.

2. The composition of claim 1 wherein same is obtained by reacting a phosphosulfurized polyisoalkylene adduct or a phosphosulfurized alpha olefin adduct and the ether soluble reaction product obtained by heating an alkali metal molybdate or ammonium molybdate and a mineral acid.

3. The composition of claim 1, wherein same is obtained by reacting a stoichiometric amount of mineral acid and an alkali metal molybdate or ammonium molybdate followed by reaction with phosphosulfurized polyisoolefins or alpha olefins wherein the alpha-olefin or polyisoolefin to $P_2S_5$ ratio is 2:1.

4. The composition of claim 1 wherein said adduct has the formula:

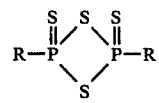

wherein R is alkenyl having from 4 to 90 carbon atoms.

5. The composition of claim 4 wherein said adduct has the formula $(C_{18}H_{35})_2P_2S_4$.

6. The composition of claim 4 wherein said adduct has the formula $(C_{14}H_{27})_2P_2S_4$.

7. The composition of claim 1, wherein said salt is $(NH_4)_6Mo_7O_{24}$.

8. The composition of claim 1, wherein said adduct has a molecular weight ranging from about 300 to about 10,000.

9. The mixture of claim 1 wherein said zinc dialkyldithiophosphate has the formula:

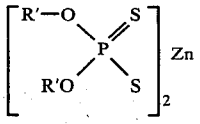

in which: R′ is a normal or branched hydrocarbyl radical having 3 to 20 carbon atoms: a combination of two or more of such hydrocarbyl radicals either in the same zinc dialkyldithiophosphate molecule or in physical mixtures of individual zinc dialkyldithiophosphates; or a radical having the formula:

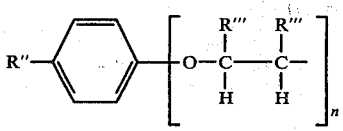

in which R″ is an alkyl radical having from 1 to 30 carbon atoms, R‴ is hydrogen or an alkyl radical having from 1 to 4 carbon atoms and n is an interger from 0 to 10.

10. The mixture of claim 9 wherein said zinc dialkyldithiophosphate is zinc di-nonylphenyldithio phosphate, zinc di-(dodecylphenoxyethyl) dithiophosphate or zinc di-(nonylphenoxyethoxyethyl) dithiophosphate.

11. A lubricating composition comprising a major amount of an oil of lubricating viscosity; an oxidation-inhibiting amount of the mixture of claim 1 and a combination of additives in an amount sufficient to achieve each additive's function.

* * * * *